United States Patent [19]

Fildan

[11] Patent Number: 5,065,916

[45] Date of Patent: Nov. 19, 1991

[54] GARMENT HANGER WITH MOLDED INTEGRAL CLIPS

[75] Inventor: Gerhard Fildan, Vienna, Austria

[73] Assignee: Fildan Accessories Corp., Englewood Cliffs, N.J.

[21] Appl. No.: 530,909

[22] Filed: May 30, 1990

[51] Int. Cl.[5] ..... A47G 25/48; A47G 25/34; A47G 25/14

[52] U.S. Cl. ..... 223/91; 223/85; 223/96

[58] Field of Search ..... 223/91, 95, 96, 93, 223/85, 88, 92; D6/315, 318, 326

[56] References Cited

U.S. PATENT DOCUMENTS

| | | | |
|---|---|---|---|
| 4,382,531 | 5/1983 | Bisk et al. | 223/96 X |
| 4,623,079 | 11/1986 | Tendrup et al. | 223/93 X |
| 4,714,183 | 12/1987 | Tontarelli | 223/91 |
| 4,828,155 | 5/1989 | Louw | 223/93 X |
| 4,884,786 | 12/1989 | Kolton et al. | 223/91 |
| 4,892,237 | 1/1990 | Duester et al. | 223/85 |
| 4,951,855 | 8/1990 | Jacobsen et al. | 223/96 X |

FOREIGN PATENT DOCUMENTS

| | | | |
|---|---|---|---|
| 544211 | 11/1983 | Australia | 223/85 |

*Primary Examiner*—Werner H. Schroeder
*Assistant Examiner*—Bibhu Mohanty
*Attorney, Agent, or Firm*—Herbert Dubno; Andrew Wilford

[57] ABSTRACT

To eliminate the tendency of resilient fingers to break off and damage garments and injure people, a hanger for brassieres, panties, swimsuit parts and the like has its retaining heads formed with downwardly and outwardly inclined support elements from which upper and lower retaining elements extend in a "T" and are provided directly with the formations engaging the garments in respective channels.

12 Claims, 2 Drawing Sheets

GARMENT HANGER WITH MOLDED INTEGRAL CLIPS

CROSS REFERENCE TO RELATED APPLICATION

This application is related to my concurrently filed copending application Ser. No. 530,733 filed May 30, 1990.

FIELD OF THE INVENTION

My present invention relates to a hanger, generally for display purposes at the point of sale, for swimwear, lingerie and like garments generally of the type having shoulder straps and, most commonly, having a two-piece configuration, including a brassiere or top having such shoulder straps and a bottom, for example, panties or the lower part of a two-piece bathing suit which is adapted to be displayed or marketed or retained with the top.

BACKGROUND OF THE INVENTION

Versatile hangers capable of the display, for merchandising, or retention of two piece garments of the type described have been provided heretofore as represented, for example, by U.S. Pat. No. 4,623,079. Generally speaking a hanger of that type comprises a hook adapted to be engaged over a bar, a cross piece or hanger bar formed on or affixed to the hook and, at the ends of this bar, a number of retainers designed to engage shoulder straps of a brassiere, swimsuit top or other garment adapted to be worn on the shoulders of the wearer. Retainers also may be provided at the bottom of the bar at each end so that the strap can be doubly secure or so that a strap of another portion of the garment can be inserted therein. Finally retainers can be provided at the ends of the bar so as to be effective in securing vertical portions of a garment such as the waistband of a pair of panties o pants or the swimsuit bottom.

In earlier devices, to provide the necessary flexibility for insertion of the garment parts in the retainers, each of the retainers has generally been constructed as a finger bent back on itself so that, at each bend, one portion of the finger extends parallel to another portion thereof but inwardly of that other portion to define the flexible free end member which can be readily deflected and engaged with the garment.

The entire hanger is molded in one piece by an injection molding process from a synthetic resin or plastic material.

Generally the hangers are supplied in bulk to a merchandiser of the garment and thus the speed with which the garments can be mounted on the hanger without damage to the garment is an important factor in the economical use of the hanger. One of the problems with the earlier hanger designs has been that a natural motion of guiding the straps or garment edges into the retainers has not been possible and, in effect, the individual using the hanger was forced to demonstrate dexterity if a neat mounting was to be accomplished rapidly.

Another drawback of earlier hanger designs of the aforedescribed type is the tendency for the individually bent free end portions of the integrally molded retainers to break off, thereby rendering the hanger useless, endangering the garment because of the sharp edges which are produced by the break, and posing a significant danger to customers and merchandising personnel because of the possibility that the broken portion could spring into the eye of the individual.

OBJECTS OF THE INVENTION

It is, therefore, the principal object of the present invention to provide an improved hanger which will avoid the drawbacks detailed above and which nevertheless can be of low cost, robust and long-lasting construction.

A more specific object of the invention is to provide an improved hanger for two-piece garments like lingerie having a brassiere portion and panty portion, swimsuits and the like, or sufficient versatility to be used for the display, marketing and storage of brassieres and panties separately, which will reduce the danger posed to the user and facilitate mounting of the garment portions on the hanger.

SUMMARY OF THE INVENTION

These objects and others which will become apparent hereinafter are attained, in accordance with the invention, in a hanger which can be injection molded in one piece or can have the bar and its retainers injection molded in one piece although the hook can be applied as a separate piece, which comprises a hook and a bar connected to the hook and formed with a retaining head at each end of the bar.

According to the invention, each retaining head includes an elongated support element extending outwardly and downwardly from the bar but coplanar therewith and resiliently connected to the bar so as to define a natural slope more nearly conforming to the shoulders of a user of the garment and on which a shoulder strap can be retained. Thus unlike prior art systems in which a purely horizontal surface is provided at the top of the bar to receive a shoulder strap, the hanger of the invention receives the shoulder straps on downwardly and outwardly sloping surfaces.

At the end of each support element, the latter forms a T with branches connected to upper and lower retaining elements which are elongated and extend back over the upper and lower surfaces of the support element.

The upper element is substantially parallel to the support element and defines, at the region at which the support element adjoins the bar, a downwardly and outwardly extending channel whose mouth lies above the upper surface of the bar, thereby allowing the individual mounting the garment on the hanger to simply slide the strap along the upper surface of the bar and into the head so that the strip will automatically be engaged in the channel.

The juxtaposed surfaces of the support element and the upper retaining element defining opposite walls of the channel may be formed with interdigitating arrays of teeth.

In addition, the inner end of the upper retaining element can be formed with a further horizontal leg extending outwardly at an acute angle to the inwardly extending portion of the upper retaining element and connected at the vertex thereof with a web bridging the two adjoining parts so as to rigidify the connection thereof this leg has a downwardly turned foot which is juxtaposed with the crossbar of the T to define an upwardly extending and converging channel therewith into which the waistband of a pair of panties, pants or a swimsuit bottom can be inserted in the upward direction.

The walls of this channel can also be provided with arrays of interdigitating teeth.

According to a feature of the invention, a stiffening web or webs can ext®nd to the aforementioned foot to reduce flexibility between the foot and the substantially horizontal leg so that outward deflection of the foot will tend to swing the entire upper retaining element toward the support element about the resilient junction between the upper retaining element and the support element and vice versa.

The downwardly extending crossbar of the T of each head resiliently connects a lower retaining element to the support element. The lower retaining element can define a lower channel with the support element, into which another loop of the strap can be inserted or into which another strap can be inserted. Preferably, the mouth of this channel lies above the lower edge of the bar and is defined by an upwardly and outwardly sloping surface connecting the lower edge of the bar with the lower edge of the lower channel, thereby automatically guiding a strap loop into this channel.

The upper surface of the lower retaining element and the lower surface of the support element defining the walls of this lower channel which can converge slightly outwardly but is generally parallel to the upper channel, can be formed with arrays of teeth which interdigitate with one another.

Since the T forms a resilient junction between the retaining elements and the support element, when a strap or garment portion is inserted beneath the upper retaining element there will be an upward bias applied to the lower retaining element and, conversely, when a garment portion is inserted in the lower channel, a downward bias will apply to the upper retaining element, thereby providing further security against undesired release of the garments.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
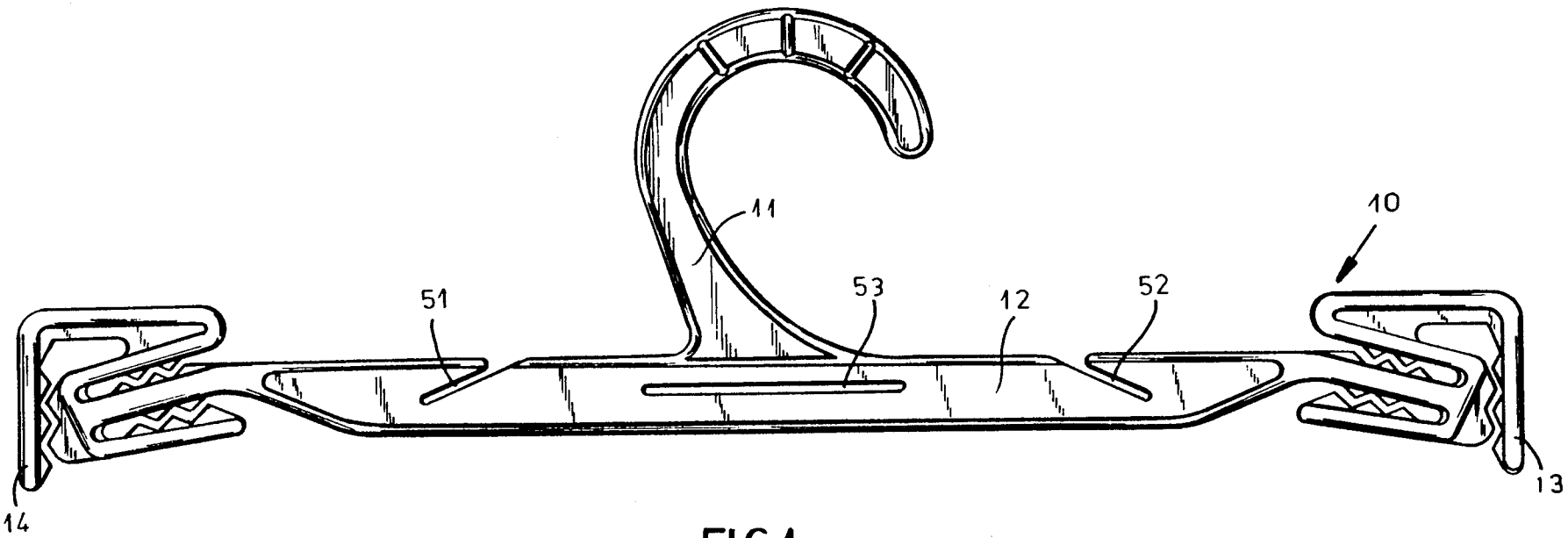
FIG. 1 is an elevational view of a hanger for the purposes described according to the invention.

The hanger 10 shown in FIG. 1 comprises a hook 11 which is injection molded integrally with the bar 12, although it can be fabricated in a separate piece and locked to the bar. Furthermore, the hook can be provided on another bar interconnected with the bar shown by flexible means when, for example, a hanger having a plurality of such bars is provided. The hook and bar arrangements of any conventional design can be used as well as long as they are provided with retaining heads 13 and 14 as will be described in greater detail with reference to FIG. 2.

Figure 2:
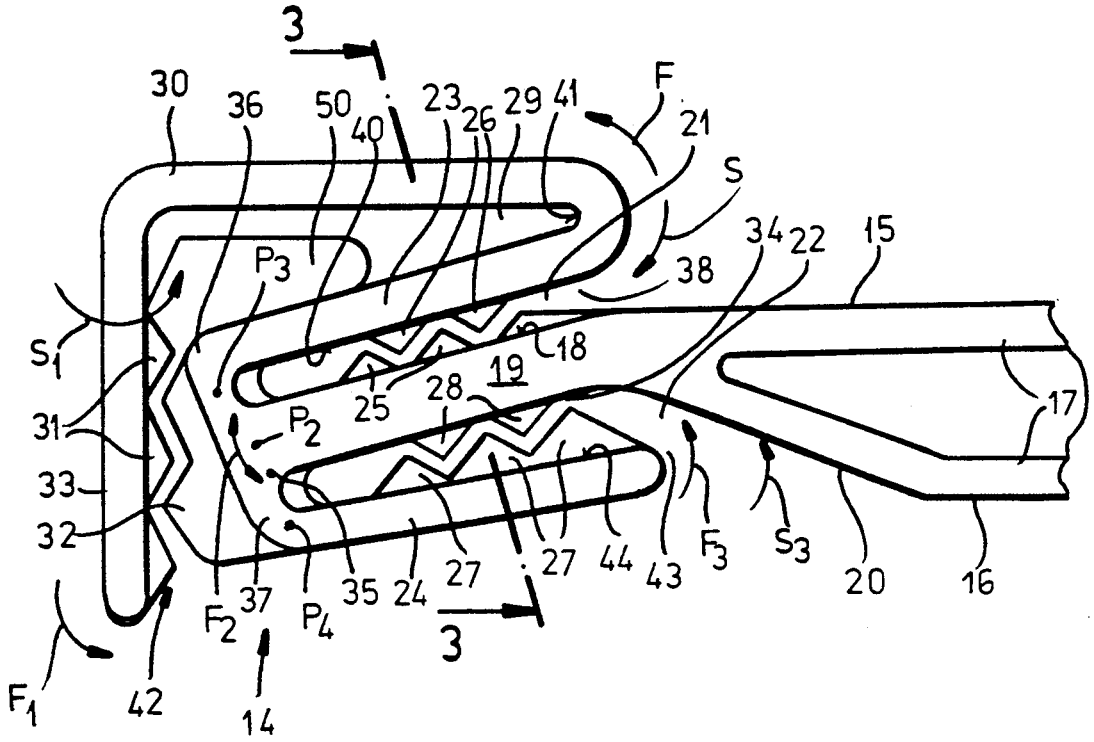
FIG. 2 is a detail view drawn to an enlarged scale of the left-hand retaining head of the hanger of FIG. 1.
Figure 3:
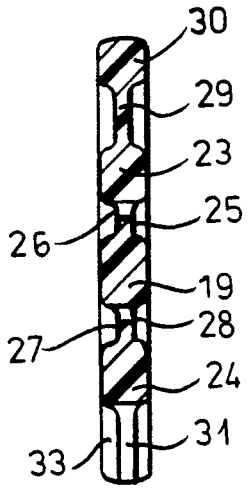
FIG. 3 is a cross sectional view taken along the line III—III of FIG. 2.

Running along the inner and outer edges of the hook and bar can be reinforcing beads 17 on one or both sides of the hanger and, as will be apparent from FIG. 2, the bar may have horizontal upper and lower surfaces represented at 15 and 16, respectively.

According to the invention, at each end of the bar, a downwardly and outwardly extending rectilinear, elongated retaining element 19 is formed unitarily with the bar and has an upper surface 18 and a lower surface 34 which slope downwardly and outwardly and are parallel to one another. This downwardly and outwardly sloping configuration has a number of advantages. Firstly, from an esthetic point of view it more naturally resembles the shoulders of a wearer so that a brassiere type garment can hang from its straps more naturally. Secondly it facilitates insertion of the straps into the respective channels.

At the end of the support element 19, a T-shaped formation 35 is provided with an upper member 36 and a lower member 37 of the T crossbar. These members are somewhat narrower than the support element 19 so as to allow bending to preferentially occur at these portions of the crossbar of the T.

The upper portion 36 merges integrally into an upper retaining element 23 of uniform width which is parallel to the support element !9 and defines a channel 21 therewith sloping downwardly and outwardly from a mouth 38 located above the upper edge 15 so that a strap can be slid along the upper edge 15 and will automatically be guided into the channel and downwardly between the upper retaining element 23 and the support element 19. Interdigitating arrays of teeth 25 and 26 are provided on the surface 18 of the support element 19 and the lower surface 40 of the retaining element 23 to grip the strap once it is inserted.

The T formation 35 forms preferred bending locations at $P_2$, $P_3$ and $P_4$ so that, for example, the insertion of a strap in the channel 21 can generate a force F which will tend to deflect the foot 33 inwardly (arrow $F_1$) and the lower retaining element 24 upwardly (arrow $F_3$) to allow these parts to more firmly engage the same or other garments.

To that end, the retaining element 23 is provided with a substantially horizontal leg 30 forming an acute angle 41 with the inner end of the retaining element and additionally connected to it by at least one stiffening web 29. At the outer portion of the leg 30, it is provided with the above-mentioned downwardly extending foot 33 which is juxtaposed with the end of the T crossbar to define a further channel 42 into which the waistband of the lower part of the swimsuit or of a pair of panties can be inserted.

The confronting surfaces of the leg 33 and the crossbar 35 of the T are formed with interdigitating arrays of teeth 31 and 32 respectively. The channel 42 converges upwardly.

The leg 33, upon application of the force F, tends to swing in the direction represented by the arrow $S_1$.

The lower retaining element 24 is formed integrally on the lower part 37 of the crossbar 35 of the T and defines with the lower surface 34 a channel 22 which likewise extends downwardly and outwardly and has its mouth 43 located above the lower edge 16 of the bar. At the end of the bar, the latter is formed with an upwardly and outwardly inclined ramp 20 designed to lead the garment into the lower channel when the garment is slid outwardly along the lower edge, thereby facilitating insertion of another portion of the strap engaged in the upper channel into the lower channel.

It has been noted that a force applied at F will result in an upward force of $F_3$ resulting from the swinging action represented by the arrow $S_3$. Conversely, the insertion of a garment in the lower channel and deflection of the lower retaining element 24 in a clockwise sense about the pivot regions $P_2$–$P_4$ will result in a swing of the upper retaining element 23 in the direction of the arrow S to enhance the force with which this retaining element engages an article received in the upper channel.

The surfaces 34 on the underside of element 19 and 44 on the upper side of element 24 can be provided with arrays of interdigitating teeth 28 and 27, respectively, engaging the strap portion inserted into the lower channel.

Because the retaining head described does not have any free finger-like looped back portions of the type characterizing prior art constructions, the danger that such fingers will break away and cause physical injury or damage to the garments is eliminated.

In this connection it should be apparent that the upper retaining element and lower retaining element directly connected to the support element by the T formation 35 themselves define the garment receiving channel and are provided directly with the formations engaging that garment, thereby eliminating the need for the resilient fingers which turn back toward the outer end of the hanger of the prior art.

It should be noted that the vertical slot or channel 42 into which the waistband of the panties can be inserted can extend at its upper end into an inwardly extending lateral slot or space 50 communicating with the channel 42 and defined between the leg 30 and the element 23 so that a bend is applied to the waistband which can be somewhat stretched to better secure the waistband on the hanger.

In addition, the hanger bar 12 can be formed below the hook 11 with a slot 53 into which a display card or like identifying or otherwise advertising medium can be inserted.

To accommodate smaller size garments and increase the versatility of the hanger, the bar of the hanger can be formed with slots 51 and 52 which are parallel to the channels 21 and into which straps of a childs garment can be inserted, for example. The opposite flanks of these slots 51 and 52 can be provided with teeth as has been described in connection with the formations at the ends of the bar. It may also be mentioned that the hook itself can be provided with extensions, tabs or the like which can receive size data, labels or advertising media.

I claim:

1. A hanger for lingerie, the hanger comprising:

a horizontally straight bar having opposite ends;

a hook midway between the ends of said bar for suspending same; and respective retaining heads formed unitarily on said bar at each of said ends, each of said retaining heads comprising a straight downwardly and outwardly inclined rectilinear support element extending from said bar at a downwardly open obtuse angle, means at an end of said support remote from said bar defining a resilient formation having a crossbar formed with upwardly and downwardly extending parts, an upper retaining element extending inwardly and upwardly from said upper part, parallel to said support element at the downwardly open obtuse angle to the bar, said support element and said upper retaining element being provided with juxtaposed parallel surfaces defining an upper channel and formed with spaced apart interdigitating arrays of teeth transversing said upper channel between said surfaces for receiving a garment strap, said upper channel having a mouth lying above an upper edge of said bar and extending downwardly and outwardly from said mouth, an outwardly extending leg formed on an inner end of said upper retaining element and substantially rigidly connected therewith, said leg extending generally parallel to said bar, a foot extending downwardly from said leg and defining an upwardly extending channel with an outer surface of said formation whereby a waistband of a garment can be inserted between said formation and said foot, a lower retaining element extending from said lower part and defining a lower channel with said support element open at a mouth above a lower edge of said bar and inclined downwardly and outwardly from said bar, and means forming a ramp extending upwardly and outwardly and connecting said lower edge of said bar with said mouth of said lower channel.

2. The hanger defined in claim 1 wherein said formation and said foot have juxtaposed surfaces defining said further channel and formed with interdigitating arrays of teeth.

3. The hanger defined in claim 2 wherein said leg and said upper retaining element are connected by a stiffening web.

4. The hanger defined in claim 3 wherein said stiffening web extends to said foot.

5. The hanger defined in claim 1 wherein said support element and said lower retaining element are formed with juxtaposed surfaces defining said lower channel and formed with interdigitating arrays of teeth.

6. The hanger defined in claim 1 wherein said support element includes downwardly open angle of substantially 160° to 170° with said bar and said ramp includes an upwardly open angle of substantially 160° to 170° with said lower edge of said bar, and at least one of said channels is flanked by formations engageable with a garment part inserted therein.

7. The hanger defined in claim 6 wherein said formations are teeth and said support element and said upper retaining element are provided with juxtaposed surfaces formed with interdigitating arrays of teeth.

8. The hanger defined in claim 7 wherein said support element and said lower retaining element have juxtaposed surfaces formed with interdigitating arrays of teeth.

9. The hanger defined in claim 8 wherein said foot and said formation have juxtaposed surfaces formed with interdigitating arrays of teeth.

10. The hanger defined in claim 9 wherein said leg and said upper retaining element are rigidly connected by at least one web.

11. The hanger defined in claim 1 wherein said upwardly extending channel extends into an inwardly extending lateral space receiving said waistband.

12. The hanger defined in claim 1 wherein said bar is formed with upper and lower bar edges, said upper edge being provided with first and second slots, each of said slots being spaced from the respective end of the bar and being defined between respective upper and lower slot edges parallel to one another and to said support element and connected by an arcuate bottom at a distance from said lower bar edge.

* * * * *